US006361312B1

(12) United States Patent
Pugh et al.

(10) Patent No.: US 6,361,312 B1
(45) Date of Patent: Mar. 26, 2002

(54) HIGH TEMPERATURE MATERIALS PROCESSING FURNACE

(75) Inventors: Sydney M. Pugh, Glenburnie; Timothy J. N. Smith, Kingston; D. Lowell Misener, Kingston; Reginald W. Smith, Kingston, all of (CA)

(73) Assignee: Millenium Biologix Inc, Ontario (CA)

( * ) Notice: Subject to any disclaimer, the term of this patent is extended or adjusted under 35 U.S.C. 154(b) by 0 days.

(21) Appl. No.: 09/605,603

(22) Filed: Jun. 28, 2000

Related U.S. Application Data

(60) Provisional application No. 60/142,448, filed on Jul. 6, 1999.

(51) Int. Cl.[7] ..... F27B 9/12

(52) U.S. Cl. ..... 432/124

(58) Field of Search ..... 432/124, 126, 432/128, 143

(56) References Cited

U.S. PATENT DOCUMENTS 5,372,500 A * 12/1994 Valentian ..... 432/225
5,549,473 A * 8/1996 Valentian ..... 432/242

* cited by examiner

*Primary Examiner*—Gregory Wilson
(74) *Attorney, Agent, or Firm*—Alston & Bird LLP

(57) ABSTRACT

The invention is directed to an automated materials processing furnace capable of high temperature operation. The furnace is moveable and enables sample insertion into either end and includes a stationary sample affixed to a replaceable tray. The furnace enables the processing of material samples under both terrestrial and microgravity conditions and also provides for the monitoring of process parameters.

26 Claims, 2 Drawing Sheets

HIGH TEMPERATURE MATERIALS PROCESSING FURNACE

This application claims benefit of U.S. Provisional No. 60/142,448, filed Jul. 6, 1999.

FIELD OF THE INVENTION

This invention relates to an automated materials processing furnace that is capable of high temperature operation. In particular, this invention enables the processing of material samples under both terrestrial and microgravity conditions and provides for the monitoring of process parameters.

BACKGROUND OF THE INVENTION

The ability to more accurately predict and/or control the behavior of materials processed at high temperatures allows researchers and industry to develop commercial processing conditions which optimize the manufacture of these materials. Such processes involve areas that deal with:

Coefficients of liquid diffusion

High temperature semiconductor crystal growth

High efficiency infra-red glass processing

Travelling liquid-solid interface characterization

The information attained from current terrestrial experiments involved in such investigations, have generated wide and varying results. The primary source of these variations is the effect of convection at high temperatures when the material is in a liquid state. The removal of convective influences provides a significantly improved determination of the underlying processing characteristics. This can be attained through the reduction of gravity.

Earth bound "near-zero" gravity ($\mu$g) can be attained for short intervals of up to 25 seconds. However, these high temperature processes normally require extended periods of $\mu$g in order to complete a particular investigation. Currently, the only viable environment capable of attaining these conditions is the NASA Space Shuttle and the International Space Station (ISS). Unfortunately, the design and operation of any hardware on the Space Shuttle or ISS are restricted by standard predefined safety criteria, physical size, power consumption and available crew time.

The safety criteria imposed by NASA on a particular flight qualified payload (facility) is directly related to the standard set of design specifications established to protect the crew and the Space Shuttle systems. Of these, the most applicable to materials processing facilities are:

Containment of toxic and/or molten specimen materials

Limitation of surface touch temperatures to below 49° C.

Control of electromagnetic interference

The size restriction is related to the need to conform to the standard payload dimensions specified for locating and mounting hardware to the Shuttle or ISS structure. The two types of standard units are a locker and a rack.

Power consumption limitations are a capacity limit for the Shuttle and ISS. A payload has a maximum allocated energy consumption per day that has a specified peak and average power limit. It is therefore desirable to design the payload for operation at the lowest possible power level since this will allow longer daily operations.

Crew time restrictions are imposed by NASA in that experiments are allocated a certain amount of weekly crew time. Since initiating the construction of the ISS in 1998, the time allocations of the crew for the operation of experiments on the Shuttle is becoming more restricted and it is predicted that it will be even more so on the ISS. Facility space is always at a premium since there is limited working space on both the Shuttle and the ISS. These restrictions indicate that for a payload to be productive in this environment, the design needs to maximize the utility of the available working space and to include components that minimize the crew time associated with conducting the experiment.

Previous designs for high temperature experimental hardware have generally been single function furnaces that required a significant amount of crew time to support the operation. One such facility is the QUELD furnace which flew in 1992. This was a single zone furnace that was designed for the processing of samples for liquid metal diffusion studies. The unit's performance allowed for the isothermal processing of materials at temperatures up to 940° C. The unit required significant astronaut intervention for process initiation, sample insertion, sample removal and quenching. The system also required the sample to move with respect to the furnace which could cause unwanted disturbances of the specimen material prior to sample cooling. As the furnace relied on astronaut interventions for processing the samples, there was a risk that the samples were not processed correctly. The requirement for astronaut interventions also limited the number of samples that could be processed based on the available crew time.

Another single function facility is the CFZF facility which is a float/travelling zone facility that utilizes focused movable halogen lamps to create a molten zone in a sample. The furnace accomplishes a travelling melt zone by slowly moving the lamp focal point along the length of the sample. The CFZF is configured only as a float zone furnace and processes one sample before requiring sample replacement by an astronaut. Manual sample insertion by an astronaut runs the risk of potential error in sample installation resulting in incorrect processing. Astronaut time limitations also restrict the number of samples that can be processed.

The AGHF facility is a Bridgeman furnace used as a single processing mode furnace for directional solidification and crystal growth. The system uses a mobile liquid cooling ring to create a moving temperature gradient. The AGHF is operated as a gradient furnace and utilizes one sample per process run and requires astronaut intervention for sample replacement. The risks for astronaut error are again present during the sample installation and the available crew time limits the number of samples in a given mission.

Another facility that was designed for use in limited studies is the LIF facility which is a single zone isothermal furnace capable of processing materials to 1600° C. The unit uses only a single sample and requires astronaut intervention for replacement. This limits the number of samples that can be processed and is also prone to astronaut error in operator procedures. The LIF employs an internal limited capacity helium gas cooling system for the sample which also limits the number of samples that can be processed.

The AADSF is another directional solidification furnace that achieves a moving temperature gradient across the sample by moving the sample over a stationary heating zone. The motion of the sample over the heating element during processing may induce unwanted vibrations in the specimen material.

The TEMPUS facility uses a degree of automation to reduce crew time but still has limitations with respect to scientific versatility. The TEMPUS is an electromagnetic levitation furnace that employs the heating of spherical samples using radio waves. The sample is stabilized in the middle of a magnetic field while the material is processed. The TEMPUS has a capacity of 22 samples contained in a carousel that automatically rotates each sample into position for processing. The unit is limited to those materials that can be contained in a magnetic field, heated by radio waves and have a sufficiently low vapour pressure when molten so as not to contaminate the processing vessel. The unit also provides only simple uniform heating.

The QUELD II facility attempted to address the design issues of process flexibility and reduced crew time. The facility is a 3 zone multi-purpose facility that was initially designed to be used on the MIR space station for processing several different types of materials (liquid metals, semiconductors and infra-red glasses) during a two year period. The sample automation of the unit was limited to two samples per astronaut intervention. There was also the requirement for the astronaut to input into the facility the correct process program number and therefore was prone to processing error. The processing of the samples involved a stationary furnace and movable samples and again the movement of the sample from the furnace to the cooling quench blocks could cause unwanted disturbances in the specimen material. The unit was also limited to the processing of materials below 900° C. with a gradient temperature performance dependent on the thermal conductivity of the sample. The entire unit was not designed to be installed in a standard locker configuration as it was to be operated in conjunction with the microgravity isolation mount (MIM) and does not conform to the mechanical and electrical connections of a Shuttle or ISS locker.

Limitations and restrictions on available resources, crew time in particular, on the Shuttle and the ISS are key considerations in any design for a high temperature materials processing facility. The optimization of the available space is crucial to maximise the potential science return on a per flight basis as the flight opportunities are rare and expensive.

There is therefore an important need to develop hardware that processes materials using a movable high temperature furnace that is designed to maximize the processing capabilities in order to support multiple types of research. It is also important that the design utilizes stationary multiple samples that minimize disturbances to the specimens, maximizes the number of material samples to be contained in the space, and minimizes the required crew intervention time. Furthermore, it is desirable for the process parameters for each sample to be automatically defined upon installation of the samples, thereby minimizing potential crew errors.

SUMMARY OF THE INVENTION

We have designed in accordance with the present invention, a system that provides for the high temperature processing of materials which utilizes a movable furnace that enables the selection of stationary samples mounted in an array to be inserted into either end of the furnace.

According to a further aspect of the present invention, the movable furnace contains two or more independently controlled thermal regions, each containing one or more heating elements, that allow for differing thermal profiles over the sample.

According to a further aspect of the present invention, the sample insertion is achieved by the movement of the furnace along its primary axis such that the stationary sample becomes inserted within the furnace.

The materials processing furnace contains one or more replaceable sample arrays each containing one or more stationary samples which are processed automatically according to predefined conditions. Periodic intervention by an operator can be used to replace the sample array and collect associated data.

According to a further aspect of the present invention, a sample is attached to the sample array via mechanical couplings that control the thermal union between the sample and array. The couplings are composed of materials that allow the thermal union between the sample and array to be thermally insulative or conductive.

The materials processing furnace contains one or more movable quench block assemblies that cool the stationary sample from a high temperature by the movement and subsequent contact of quench blocks on to the sample.

According to a further aspect of the present invention, the quench blocks are composed of a series of segmented sections that self adjust to the exterior profile of the sample and remove heat via passive heat sinks or active heat transfer devices.

The materials processing furnace may be operated in microgravity in order to eliminate the scientifically disruptive effects of convection.

According to a further aspect of the present invention, the microgravity condition is provided by operation in an interface shell that is used in a Shuttle or ISS locker and can be used in combination with an active microgravity isolation platform to minimize external vibration disturbances.

The materials processing furnace contains one or more protective layers of physical containment in order to meet the safety requirements of high temperature processing in microgravity conditions.

According to a further aspect of the present invention, the physical containment can be provided entirely by the sample or by the furnace or a combination of both.

According to a further aspect of the present invention, physical manipulation of the material specimen is accomplished though external stimulation, used singly or in combination, and consisting of magnetic, electrical or thermal devices that do not compromise the integrity of any protective layers of physical containment.

The materials processing facility may be configured to accommodate one or more materials processing furnaces as interchangeable units. Each of the interchangeable units contains electronic modules to control the operation of the furnace, and the interchangeable units connect with a base unit that provides for mechanical and electronic attachment. The base unit contains one or more electronic modules that allow for the remote control and operation of the furnaces.

According to a further aspect of the present invention, the interchangeable units may incorporate a touch screen display to enable monitoring and adjustment of the processing facility.

The utility of the present invention has significant advantages associated with microgravity material investigations, it is also foreseen that there will be considerable terrestrial application of the present invention for experimentation in a terrestrial laboratory in preparation for flight and for regular experimental use.

BRIEF DESCRIPTION OF THE DRAWINGS

The following drawings illustrate embodiments of the present invention.

The drawings are intended for illustrative purposes only and are not meant to restrict the scope of the present invention.

DETAILED DESCRIPTION OF THE PREFERRED EMBODIMENTS

Figure 1:
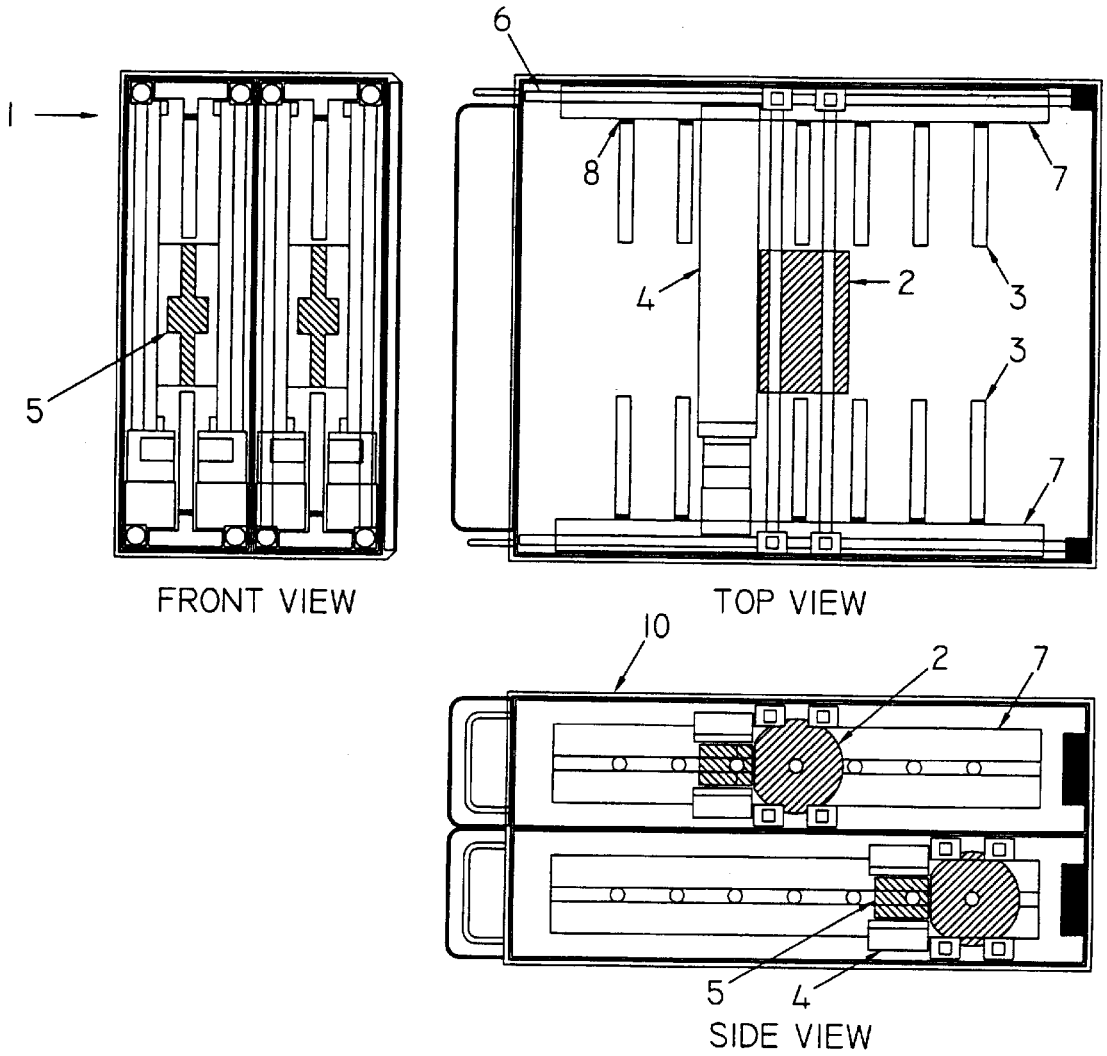
FIG. 1 is an illustration of the internal configuration of the high temperature materials processing furnace.
Figure 2:
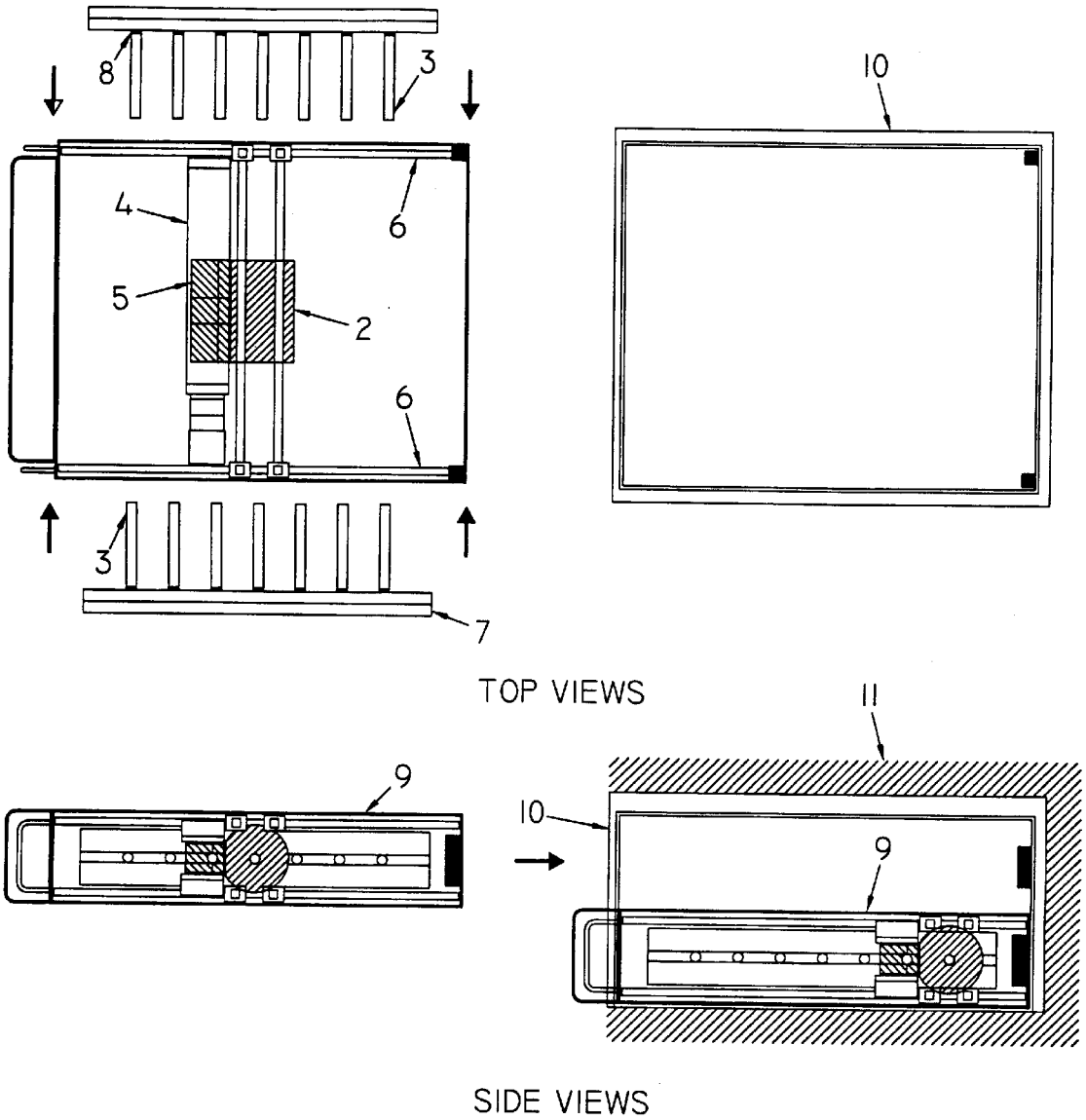
FIG. 2 is an illustration depicting the loading of the sample array and the subsequent installation of a furnace tray into the interface housing.

Referring to FIGS. 1 and 2, the high temperature materials processing furnace of the present invention preferably embodies the following characteristics:

- Control over five independent furnace zones to achieve multiple types of heating profiles.
- Utilization of reflective vacuum insulation to minimize the required power to attain a maximum operational temperature of 1300° C.
- Use of a moveable furnace module that minimizes disturbances of the sample during processing since the samples are always stationary.
- Planar sequencing of the furnace module using a rail/motor system that allows for 28 samples to be contained in the hardware volume.
- Control of the furnace zones and monitoring thermal processing environment via five thermocouples mounted on each sample.
- Utilization of sample insertion into the furnace to connect sample thermocouples and thermal protection devices thus minimizing the wiring complexity of the sample array and the furnace enclosure.
- Two levels of sample material containment present around each sample.
- Use of universal multiple sample arrays that are easily replaced and contain all the pre-programmed processing information.
- Use of standard RS-232 communication protocols to link the furnace with on-orbit computer systems and ground control.
- Utilization of two identical furnace trays that are networked through an external housing to provide processing redundancy such that continued processing is possible in the event that one of the two units fails to operate.

The high temperature materials processing facility, indicated by reference numeral 1, contains a moveable furnace module 2 that is used to create the controlled thermal environment to process multiple stationary samples 3. The furnace module is a cylindrical design that contains five electrically heated windings (zones) constructed on a hollow ceramic core. Each winding has an associated control thermocouple used as an off-sample pre-heat sensor. This core is surrounded by a small layer of high temperature insulation followed by a custom designed reflective vacuum insulation (RVI) housing. This RVI significantly increases the efficiency of the furnace which allows higher temperatures to be obtained at a lower power consumption. Processing of 1300° C. is possible with a power consumption of less than 200 W. Furthermore, this design results in a sufficiently low external surface temperature of the furnace module that conventional connectors and wiring may be used. The furnace module is designed as a symmetrical unit which doubles the sample capacity. This is accomplished by designing the furnace module with an opening on both ends of the hollow core to enable equivalent processing regardless of the direction of sample insertion.

Sample insertion is achieved by the movement of the furnace module. This motion is provided by a linear drive system (carriage) 4 that contains two parallel linear drives, one of which is mechanically coupled to the furnace module 2. The linear drive connected to the furnace module is used to move the furnace over the sample 3 being processed on either the left or right side of the tray. The reset position of the furnace is on the center line of the tray, midpoint in the linear drive travel. This center line region contains free space to allow the carriage to travel back and forth in the tray to access different samples.

The second linear drive on the carriage 4 is connected to a spring-loaded pair of quench blocks 5 that are used to quickly cool a thermally processed sample 3. In the reset position the quench blocks are in an open position. When the linear drive sequences the quench blocks over a sample to be cooled, the action of moving the quench blocks over the sample causes the quench blocks to move into thermal contact with the sample. The quench blocks employ a segmented design and are spring loaded to ensure good thermal contact with the sample. The quench blocks employ both passive and active heat absorption.

The furnace and quench block carriage 4 is sequenced front to back over the desired sample location by using a rail based linear drive 6. The resulting combination of the carriage and rail linear actuation produces a planar linear drive system with 2 degrees of freedom. All three drive motors used in the tray are controlled using an IMS483I2 RS-232 stepper motor controller.

The samples 3 used in this design are stationary throughout the high temperature processing. The samples are located on both the right and left sides of the tray. The samples are mounted on a plate which makes up the sample array 7. This array may be removed and replaced with a new sample array and/or a sample array from another tray. Each sample array contains up to seven samples for a total of 14 samples per tray (28 per payload). The array also contains the necessary electronics that when installed in the tray (right or left) provide all the processing information for each sample in the array. Configuring samples in this format allows for:

- Sample processing redundancy.
- Specific control over the thermal union between the sample and the array.
- Accurate process control via sensors directly coupled to the sample.
- Efficient re-supply as multiple samples are pre-mounted on the sample array.

Each sample 3 is cylindrical in shape and is composed of a connecting spacer 8 (conducting or insulating), a thermocouple sleeve, two layers of metallic containment tubes, the required crucible containment for the material under investigation and the material specimen. The connecting spacer is designed for high or low thermal conductivity in order to attain the desired gradient or isothermal performance. Specialty samples can be employed that use an automated mechanical shear action within the sample to segment a molten specimen at the end of thermal processing. This action traps scientific evidence without the need for rapid quenching of the sample.

The approximate overall dimensions of the sample 3 are 12 mm diameter by 100 mm in length. Multiple thermocouples are present in the sample and these process monitoring components become active when the furnace is fully engaged over the sample being processed. Process control is automatically diverted from the preheat thermocouples present in the furnace module to the sample thermocouples to improve processing accuracy. This feature of the invention significantly reduces wiring and electronics complexity to connect with multiple samples, each containing multiple thermocouples. Furthermore, each sample contains overtemperature protection in the form of a thermal fuse that has the capability to disable further processing in the event of a malfunction. This allows samples to be NASA flight certified at less than the maximum run-away temperature of the furnace module 2.

Temperature control of the five zones present in the furnace module 2 is provided by a multi-loop PID temperature process controller (OMEGA CN5116). This electronic unit provides multiple independent controllable outputs; each of which can be independently accessed and autotuned. Heating and cooling profiles can be attained by digitally adjusting the process parameters of the controller. Ten of the available channels are allocated for zone temperature control. The remaining channels are utilized to monitor environmental temperatures.

Each furnace tray 9 contains dedicated electronics that monitor and queue all the activities within each tray. These tasks include the monitoring and control of motor activity, the retrieval and storage of sample array processing information, the setup and monitoring of process conditions according to specific sample requirements, and the monitoring of the state of all functional devices. In addition, it will perform external communications with the locker interface and initiate periodic self diagnostics. All process and functional information can be externally accessed through the locker interface communications port. Since all information is available through the communications port, only minimal information needs to be presented on the front panel of each tray. The front panel will contain a touch screen LCD display as a source of input and output of process information and for the display of error codes. There will also be light indicators present for displaying power and microcontroller status.

The tray 9 is designed to slide into and connect with the locker interface shell 10. This interface shell is configured for either the Shuttle or ISS lockers and is adaptable for use with microgravity isolation systems. Both power and communications will be available through mating connectors on the rear of the locker interface shell. The tray, with sample arrays 7 installed, can serve as one or more containment levels for the specimen material in the sample 3.

The high temperature materials processing furnace of this invention may be accommodated in a standard locker 11 present in the Space Shuttle or ISS Express Rack. This locker contains the interface shell 10 that mates with the two furnace trays 9 and the on-orbit systems which include power and communications.

While the design has been based around constraints imposed by NASA for use as a flight approved system, the functionality and versatility of the present invention is foreseen to have market potential as a terrestrial research and industrial process tool.

Although preferred embodiments of the invention are described in detail herein, it will be understood by those skilled in the art that variations may be made thereto without departing from the spirit of the invention or the scope of the appended claims.

We claim:

1. A high temperature materials processing furnace comprising a) a moveable furnace having a first end and a second end that enables sample insertion into either said first end or said second end of said furnace; and b) a stationary sample affixed to a replaceable sample array.

2. The materials processing furnace according to claim 1, wherein said moveable furnace contains two or more independently controlled thermal regions that allow for differing thermal profiles over the sample.

3. The materials processing furnace according to claim 2, wherein said thermal regions contain one or more heating elements and one or more temperature monitoring devices.

4. The materials processing furnace according to claim 2, wherein said thermal profiles are created by controlling the temperature of the furnace at different points along the primary axis of the sample.

5. The materials processing furnace according to claim 1, wherein said sample insertion is achieved by the movement of the furnace along its primary axis such that said stationary sample becomes inserted within the furnace.

6. The materials processing furnace according to claim 1, wherein said replaceable array contains one or more stationary samples.

7. The materials processing furnace according to claim 6, wherein said processing furnace: a) contains multiple replaceable arrays with each array containing multiple samples; b) said samples being processed automatically according to predefined conditions; and c) periodic intervention by an operator to replace said sample arrays and to collect associated recorded data.

8. The replaceable array according to claim 6, wherein said stationary sample is attached to the array via a mechanical coupling that controls the thermal union between the sample and the array.

9. The mechanical coupling according to claim 8, wherein said thermal union results in the sample being thermally insulated from the array.

10. The mechanical coupling according to claim 8, wherein said thermal union results in the sample being thermally conductive to the array.

11. The materials processing furnace according to claim 1, wherein said stationary sample is cooled from a high processing temperature by the movement and subsequent contact of quench blocks.

12. The materials processing furnace according to claim 11, wherein said quench blocks are composed of a series of segmented sections that self adjust to the exterior profile of said sample to maximize the thermal conductivity of the mechanical contact.

13. The materials processing furnace of claim 11, wherein said quench blocks contain interface components that provide mechanical compliance whereby the contacting surfaces of the quench blocks conform to the exterior profile of said sample to maximize the thermal conductivity of the mechanical contact.

14. The materials processing furnace of claim 11, wherein said quench blocks provide increased thermal capacity through the use of passive heat sinks.

15. The materials processing furnace of claim 11, wherein said quench blocks provide increased thermal capacity through the use of active heat transfer devices.

16. A high temperature materials processing furnace capable of operation in microgravity conditions and containing a) a moveable furnace that enables sample insertion into either end of the furnace; b) a stationary sample affixed to a replaceable array.

17. The materials processing furnace according to claim 16, wherein said microgravity conditions represent operation on an active platform designed to minimize disturbances to said microgravity conditions.

18. The materials processing furnace according to claim 16, wherein said sample would provide one or more protective layers of physical containment in order to meet the safety requirements of said high temperature processing in microgravity conditions.

19. The materials processing furnace according to claim 16, wherein said furnace would provide one or more protective layers of physical containment in order to meet the safety requirements of said high temperature processing in microgravity conditions.

20. The materials processing furnace according to claim 18, wherein physical manipulation of a materials specimen inside said sample is achieved by the application of an external stimulating source that does not compromise the integrity of said protective layer(s) of physical containment.

21. The materials processing furnace according to claim 20, wherein the external stimulating source is selected from the group consisting of magnetic, electrical, and thermal energy sources.

22. A high temperature processing facility containing: a) one or more materials processing furnaces configured as interchangeable units; b) a base unit that enables the mechanical and electronic attachment of said materials processing furnaces; c) one or more electronic units to control the operation of said processing furnaces; d) an electronic link to allow for remote control and operation of said processing furnaces.

23. The high temperature processing facility according to claim 22, wherein said materials processing furnace contains: a) a moveable furnace that enables sample insertion into either end of the furnace; b) a stationary sample affixed to a replaceable array.

24. The high temperature processing facility according to claim 22, wherein said electronic units incorporate a touch sensitive screen to enable the monitoring and adjustment of said processing facility.

25. The materials processing facility according to claim 22, wherein operation of said facility occurs under microgravity conditions.

26. The materials processing furnace according to claim 26, wherein said microgravity conditions represent operation on an active platform designed to minimize disturbances to said microgravity conditions.

* * * * *

UNITED STATES PATENT AND TRADEMARK OFFICE

CERTIFICATE OF CORRECTION

PATENT NO. : 6,361,312 B1
DATED : March 26, 2002
INVENTOR(S) : Pugh et al.

It is certified that error appears in the above-identified patent and that said Letters Patent is hereby corrected as shown below:

Column 10,
Lines 11-12, “claim 26” should read -- claim 25 --.

Signed and Sealed this

Second Day of July, 2002

*Attest:*

JAMES E. ROGAN
*Director of the United States Patent and Trademark Office*

*Attesting Officer*